US011266235B2

(12) United States Patent
Rinck

(10) Patent No.: US 11,266,235 B2
(45) Date of Patent: Mar. 8, 2022

(54) UNDER CABINET MOUNTED SHELVING SYSTEM

(71) Applicant: Lance A. Rinck, Olathe, KS (US)

(72) Inventor: Lance A. Rinck, Olathe, KS (US)

( * ) Notice: Subject to any disclaimer, the term of this patent is extended or adjusted under 35 U.S.C. 154(b) by 131 days.

(21) Appl. No.: 16/729,916

(22) Filed: Dec. 30, 2019

(65) Prior Publication Data

US 2020/0205565 A1 Jul. 2, 2020

Related U.S. Application Data

(60) Provisional application No. 62/917,798, filed on Jan. 2, 2019.

(51) Int. Cl.
*A47B 77/14* (2006.01)
*A47B 43/00* (2006.01)

(52) U.S. Cl.
CPC ..... *A47B 77/14* (2013.01); *A47B 43/003* (2013.01)

(58) Field of Classification Search
CPC ..... A47B 43/03; A47B 43/006; A47B 43/003; A47B 77/10; A47B 77/12; A47B 77/14; A47B 77/16; A47B 46/005; A47G 29/087
See application file for complete search history.

(56) References Cited

U.S. PATENT DOCUMENTS 957,324 A * 5/1910 Gall ..... E04G 5/043 108/149
1,211,286 A * 1/1917 Carney ..... A47B 43/006 108/164
2,946,458 A * 7/1960 Miller ..... A47B 77/14 211/88.01
3,282,547 A * 11/1966 Ables ..... A47B 43/006 248/546
4,974,523 A * 12/1990 Giarratana ..... A47B 43/006 108/42
5,019,126 A * 5/1991 Post ..... A47G 25/0685 211/100
5,125,517 A * 6/1992 Martinell ..... B62H 3/12 211/17
6,119,879 A * 9/2000 Acchione ..... A47B 77/10 16/359
6,224,029 B1 * 5/2001 Marble ..... A47B 43/006 248/214
6,805,246 B1 * 10/2004 Manabat ..... A47J 47/16 108/25
8,397,923 B2 * 3/2013 Tan ..... F16M 13/027 211/85.15
8,480,047 B2 * 7/2013 Sloan ..... A47B 43/006 248/243
8,517,323 B1 * 8/2013 Gregory ..... A47J 47/16 248/309.1
8,656,842 B1 * 2/2014 McDonley ..... A47B 23/04 108/42
8,915,384 B2 * 12/2014 Immerman ..... A47K 10/04 211/119
9,346,524 B2 * 5/2016 Dubois ..... B63B 32/80
(Continued)

*Primary Examiner* — Patrick D Hawn
(74) *Attorney, Agent, or Firm* — Arthur K. Shaffer; McDowell Rice Smith & Buchanan, PC

(57) ABSTRACT

The present invention provides an improved under cabinet mounted storage system with a one rotateable arm extending between a mounting anchor and a vertical support structure with an angled channel adapted for slidable receipt of at least one common kitchen, cooking or staging items.

14 Claims, 7 Drawing Sheets

(56) References Cited

U.S. PATENT DOCUMENTS

| | | | | |
|---|---|---|---|---|
| 9,427,113 | B2 * | 8/2016 | Rinck | A47J 45/02 |
| 10,188,240 | B2 * | 1/2019 | Clarke | A47B 77/14 |
| 10,426,263 | B1 * | 10/2019 | Whaley | A47B 77/08 |
| 10,889,249 | B1 * | 1/2021 | Snyder | A47F 5/0006 |
| 10,897,992 | B2 * | 1/2021 | Vandenham | A47B 43/006 |
| 2003/0205645 | A1 * | 11/2003 | Kaposi | A47G 21/14 248/37.3 |
| 2011/0226714 | A1 * | 9/2011 | Huentelman | A47J 47/16 211/70.7 |
| 2012/0175331 | A1 * | 7/2012 | Yu | A47B 43/006 211/119 |
| 2014/0014607 | A1 * | 1/2014 | Mikich | A47B 96/027 211/195 |
| 2015/0060383 | A1 * | 3/2015 | Gregory | A47B 43/006 211/186 |
| 2015/0201750 | A1 * | 7/2015 | Hopkins | A47B 43/003 211/75 |
| 2015/0250306 | A1 * | 9/2015 | Bunch | A47B 77/10 312/248 |
| 2015/0305594 | A1 * | 10/2015 | Jarl | A47B 77/02 211/41.5 |
| 2015/0351570 | A1 * | 12/2015 | Lukjan | A47G 21/14 211/70.7 |
| 2016/0088933 | A1 * | 3/2016 | Rossignol | A47B 88/60 312/270.2 |
| 2016/0143485 | A1 * | 5/2016 | Rinck | F16M 13/022 211/116 |
| 2020/0077791 | A1 * | 3/2020 | Vandenham | A47B 43/006 |
| 2020/0205565 | A1 * | 7/2020 | Rinck | A47B 77/14 |

* cited by examiner

UNDER CABINET MOUNTED SHELVING SYSTEM

CROSS-REFERENCE TO RELATED APPLICATION

This application claims the benefit of the prior filed U.S. provisional application No. 62/917,798 filed Jan. 2, 2019 which is incorporated herein by reference.

FIELD OF THE INVENTION

The present invention relates generally to collapsible cooling racks and more specifically to a storable kitchen system with a foldable kitchen rack mounted underneath a kitchen cabinet providing additional storage space and which rotates between an upper and a lower position for holding various kitchen related items, the vertical support including an integrated channel for receiving a variety of kitchen related accessories like a removable spoon rest or a pan lid or even for use with a computer tablet.

BACKGROUND OF THE INVENTION

Typical kitchen space is difficult to maintain. Most kitchen counters are flat horizontal surfaces. In design these counters are flat to allow for work around the kitchen. However, these counter spaces are often cluttered with kitchen gadgets, appliances and other kitchen items which take away from the working area of these counters. While cooking in the kitchen, it is often desirable to place a hot item out of reach or to find someplace to hold an item like plates, cooking sheets or lids when these countertops are otherwise occupied. Therefore, it is desirable to have a retractable storage area which can be used without occupying a countertop area.

Some prior attempts to provide additional counter space include utilizing carts, racks or other portable tables or semi-portable storage areas. However, these storage areas even further clutter an already crowded kitchen area and during times of nonuse, obstruct movement around the kitchen. In addition, these carts or racks are difficult to move and can be very heavy depending on the items stored along the rack shelves. It therefore would be beneficial to provide additional storage space which does not obstruct movement within the kitchen while the storage space is not in use.

SUMMARY OF THE INVENTION

The present invention provides an improved under cabinet mounted storage system associated with a mounting surface of a wall cabinet and adapted for repeated movement between an upper orientation and a lower orientation, said improved undermount cabinet storage system comprising: a mounting anchor secured to mounting surface of the wall cabinet; a vertical support structure extending from a first side to a second side; at least one rotatable arm pivotally secured to at least one of said vertical support structure and said mounting anchor whereby said rotatable arm is rotatable between the upper orientation and the lower orientation; and said vertical support structure further comprising at least one angled channel configured for slidable receipt of at least a kitchen item, cooking item or staging item when said vertical support structure is in the lower orientation.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
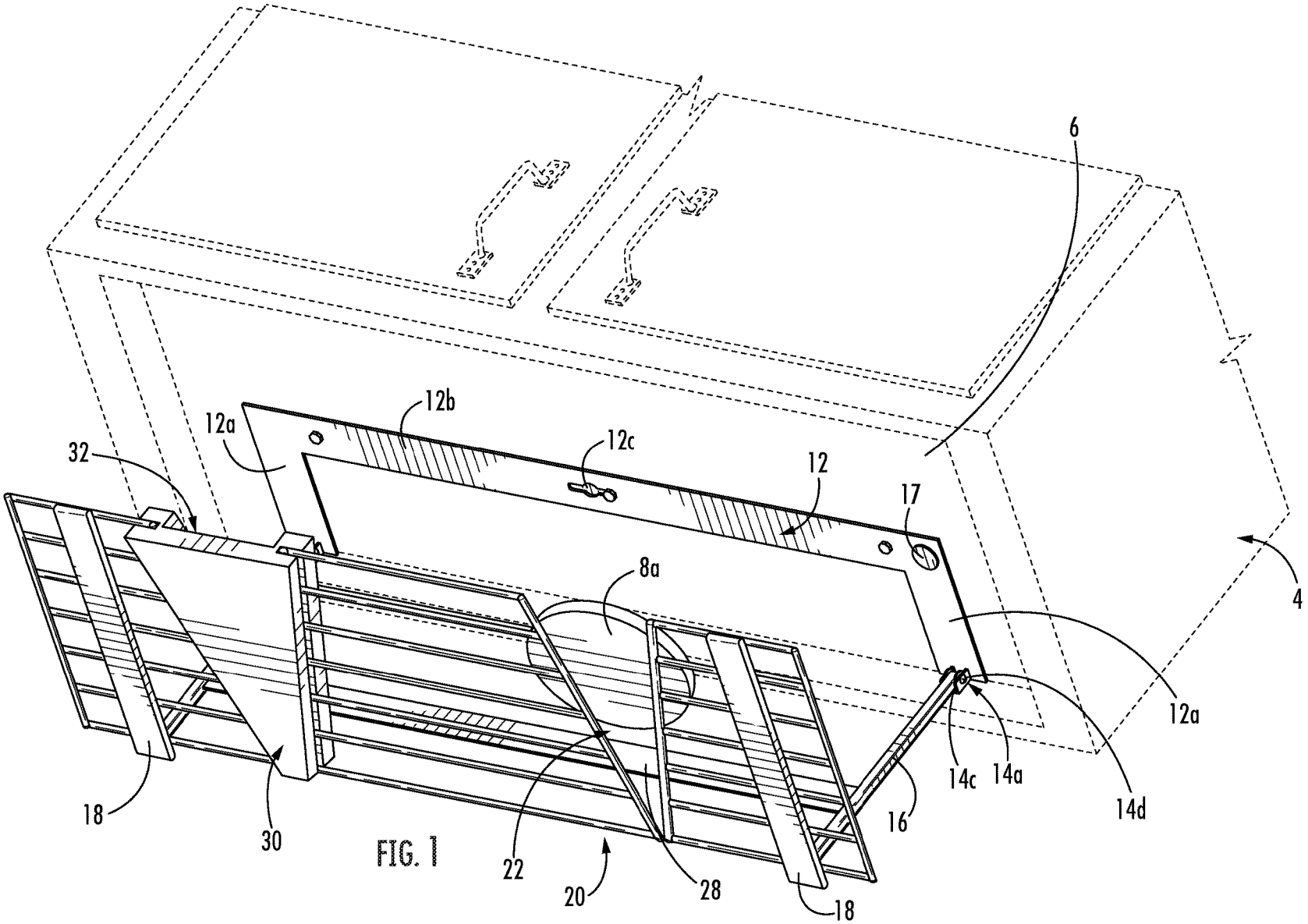
FIG. 1 is a bottom perspective view of an exemplary embodiment of an improved undermount cabinet storage system in accordance with the present invention.

As illustrated in FIG. 1, an improved under cabinet mounted storage system 10, also referred to herein as the system, is configured for receipt of kitchen items 8, cooking items 8*a* or staging items 8*b*. The kitchen items may include common kitchen articles like plates, cooking sheets, etc., which are typically stored in kitchen wall cabinets 4. Cooking items 8*a* may include, but are not limited to, pots, pans, lids, whisks, spoons, etc. Staging items 8*b* are common vessels like ramekins, bowls or measuring cups which can hold various ingredients, dry or wet, which may be needed while cooking to prepare a given recipe. The improved cabinet mounted storage system 10 typically provides an open grid-like vertical support 20 for receiving the various cooking items 8, kitchen items 8*a* or staging items 8*b*.

The depicted embodiment of the improved cabinet mounted storage system 10 depicted in FIGS. 1-7 also includes a pair of angled receivers 22 configured for slidable receipt of the cooking, kitchen or staging items 8, 8*a*, 8*b*. By way of example, FIG. 1 illustrates a pan lid 8*a* and removable spoon rest 30 received within the depicted angled receiver 22.

The improved undermount cabinet storage system 10 generally includes a mounting anchor 12 for mounting the system 10 to a lower cabinet surface 6 associated with a typical wall cabinet 4. Generally, the mounting anchor 12 provides sufficient dimensions to support the system 10 during use, storage and as it moves between an upper and a lower orientation. The mounting anchor 12 also provides sufficient support for rotation of a rotateable arm 16 as it moves between an upper and a lower orientation with the rotateable arm 16 extending downwardly from the wall cabinet 4.

In an alternative embodiment of the improved undermount cabinet storage system 10, a tensioned mounting structure may be utilized with a from support (not shown) separated from a rear support (not shown) with a pair of adjusters (not shown) exciting the desired pressure at the corresponding front and rear wall cabinet structure for mounting the improved undermount cabinet storage system 10 directly to the wall cabinet in the horizontal or upper orientation while the system 10 is recessed and hidden from view. Alternatively, a mounting bracket (not shown) may be provided with a front support structure (not shown) spaced from a rear support structure (not shown) separated with an interconnecting member (not shown), the mounting bracket being secured to the mounting surface 6 of the wall cabinet 4 and utilizing a known adjustment mechanism utilizing adjustment means such as ratcheting means, rotating means, telescoping means, or frictional means.

An embodiment of the mounting anchor 12 secured to the lower cabinet surface 6 is illustrated in FIG. 1. In the depicted embodiment, the mounting anchor 12 has a flat rectangular shaped cross-section which extends inwardly from the back of the wall cabinet 4 along the lower cabinet surface 6. Generally, the mounting anchor 12 provides sufficient supporting structure for retaining any received kitchen, cooking or staging items 8, 8*a*, 8*b* (referred to herein collectively as items) while the system 100 is in the lower orientation and for supporting the system 10 during rotation between the upper and lower orientations and for supporting the system 10 and any received items 8, 8*a*, 8*b* while in the lower orientation. In the upper orientation, depicted in FIG. 7, the vertical support 20 is rotated upside-down with the rotateable arm 16 extending horizontally along the lower cabinet surface 6 and positioned along the bottom of the vertical support 20. In the lower orientation, depicted in FIG. 1, the vertical support 20 is right-side up with the rotateable arm 16 extending vertically between the cabinet mounting surface 6 and the vertical support 20.

The illustrated embodiment of the mounting anchor 12 depicted in FIGS. 1-7, includes a pair of outward supports 12*a* joined by a spanning member 12*b* mechanically fastened to the lower cabinet surface 6 with, for example, a hexagonal fastener. The mounting anchor 12 depicted in FIG. 1, also includes an elongated central receiver 12*c* with a central aperture adapted for aligned receipt of a mechanical fastener. Generally, the elongated central receiver 12*c* allows for adjustable alignment of the mounting anchor 12 along the lower cabinet surface 6.

The depicted mounting anchor 12 is illustrated as being mounted towards the rear of the wall cabinet 4, the vertical support 20 swinging upwardly towards the front of the cabinet where it is secured front view in a recessed horizontal orientation. Alternatively, the mounting anchor 12 could be secured near the front of the wall cabinet 4 and the vertical support 20 could swing upwardly towards the rear of the wall cabinet for secured in the recessed horizontal orientation. Additionally, the vertical support 20 could swing downwardly from the recessed horizontal orientation and swing down from the left to the right or vice versa and then rotate horizontally as desired. All of these configurations would involve known folding and rotating techniques.

While one exemplary mounting anchor 12 is depicted in FIG. 1, other configurations including those described herein are considered within the scope of the present invention with the mounting anchor 12 being secured to the lower cabinet surface 6 and for support of the vertical support 20 while allowing for rotation from an upper orientation to a lower orientation in which the vertical support 20 is secured in either the upper or lower orientation.

Numerous brackets and catches may be incorporated into the present invention to help support the system 10 in a recessed horizontal orientation or a vertical orientation. For example, a plurality of catches or fasteners 17 may be used to secure the system 10 during transition from the lower orientation to the upper orientation or for securing it in the upper orientation. Exemplary catching mechanisms 17 may be positioned along the system 10 for example, along the vertical support 20, the rotateable arm(s) 16 and/or the mounting anchor 12 or as otherwise desired to secure the system 10 in the upper orientation, tire lower orientation or while transitioning between the upper and lower orientations.

By way of example, FIG. 1 illustrates a magnetic catching mechanism 17 positioned along the mounting anchor 12 for securing the depicted, magnetically responsive vertical support 20 while in the upper orientation. Another magnetically charged catching mechanism 17 may be used to secure a longitudinal runner 18 to the rotateable arm 16 as the vertical support 20 is rotated. Generally, each catching mechanism 17 has sufficient characteristics to secure and retain the vertical support 20 during rotation and when rotated to the upper orientation while stored. By way of example, the magnetically charged catching mechanism 17 may employ a rare-earth style magnet with strong magnetic properties like neodymium iron boron magnets which may have sufficient magnetic properties for maintaining the vertical support 20 in the desired orientation.

Figure 4:
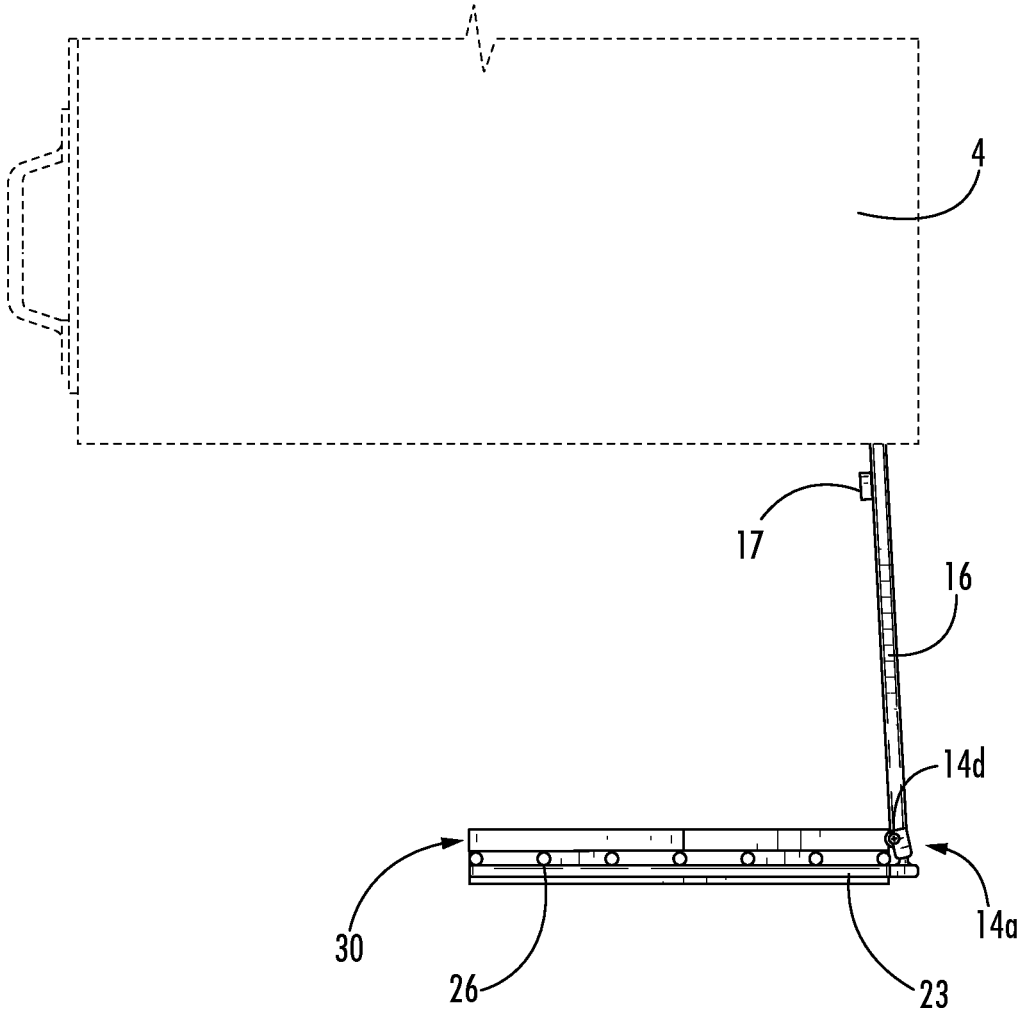
FIG. 4 is a right-side elevation of the embodiment depicted in FIG. 1.
Figure 5:
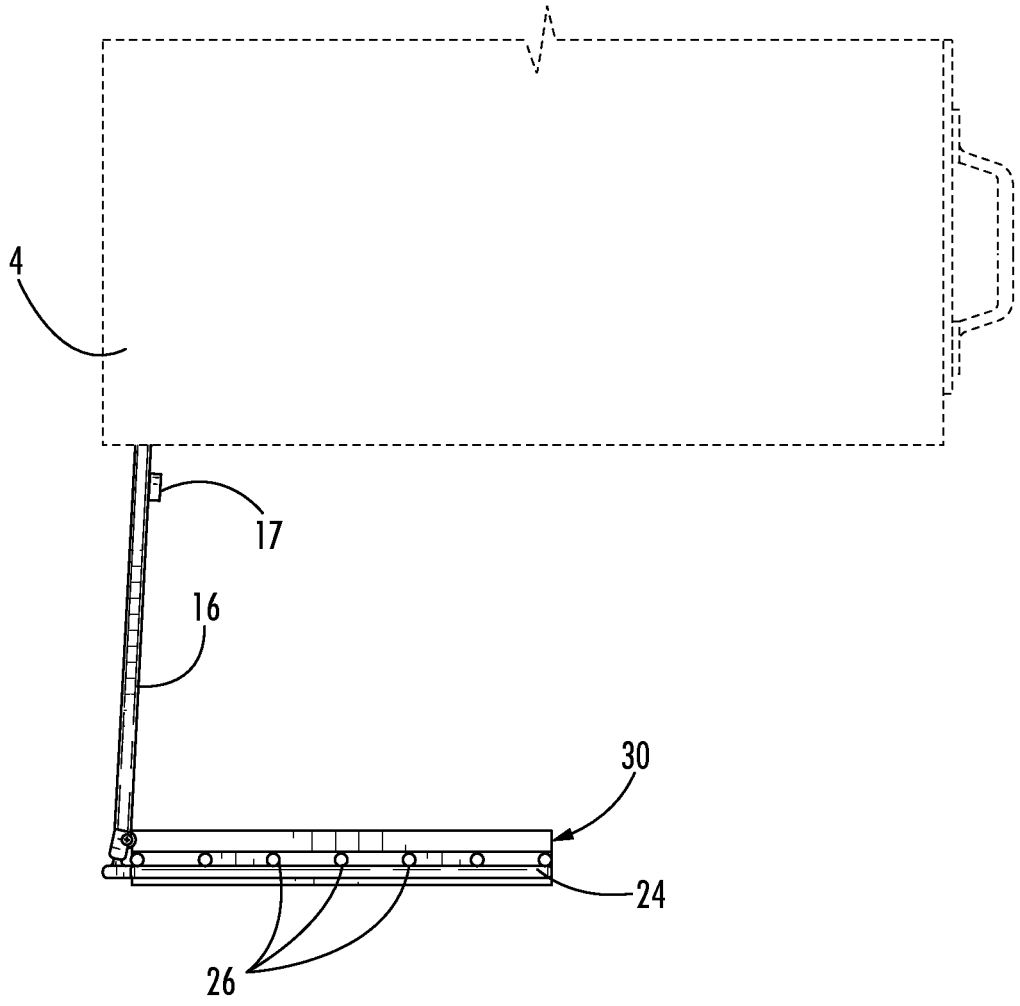
FIG. 5 is a left-side elevation of the embodiment depicted in FIG. 1.
Figure 6:
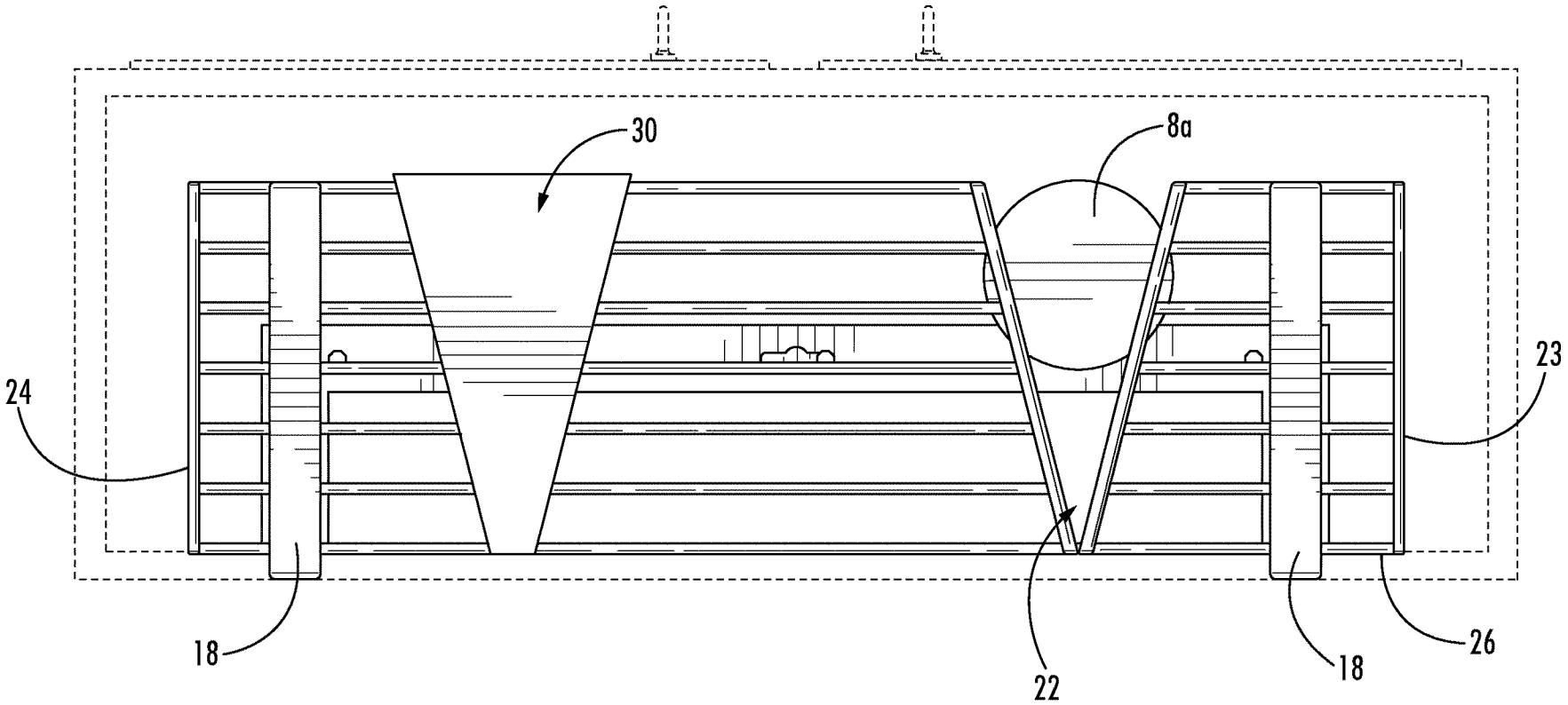
FIG. 6 is a bottom plan view of the embodiment depicted in FIG. 1.
Figure 7:
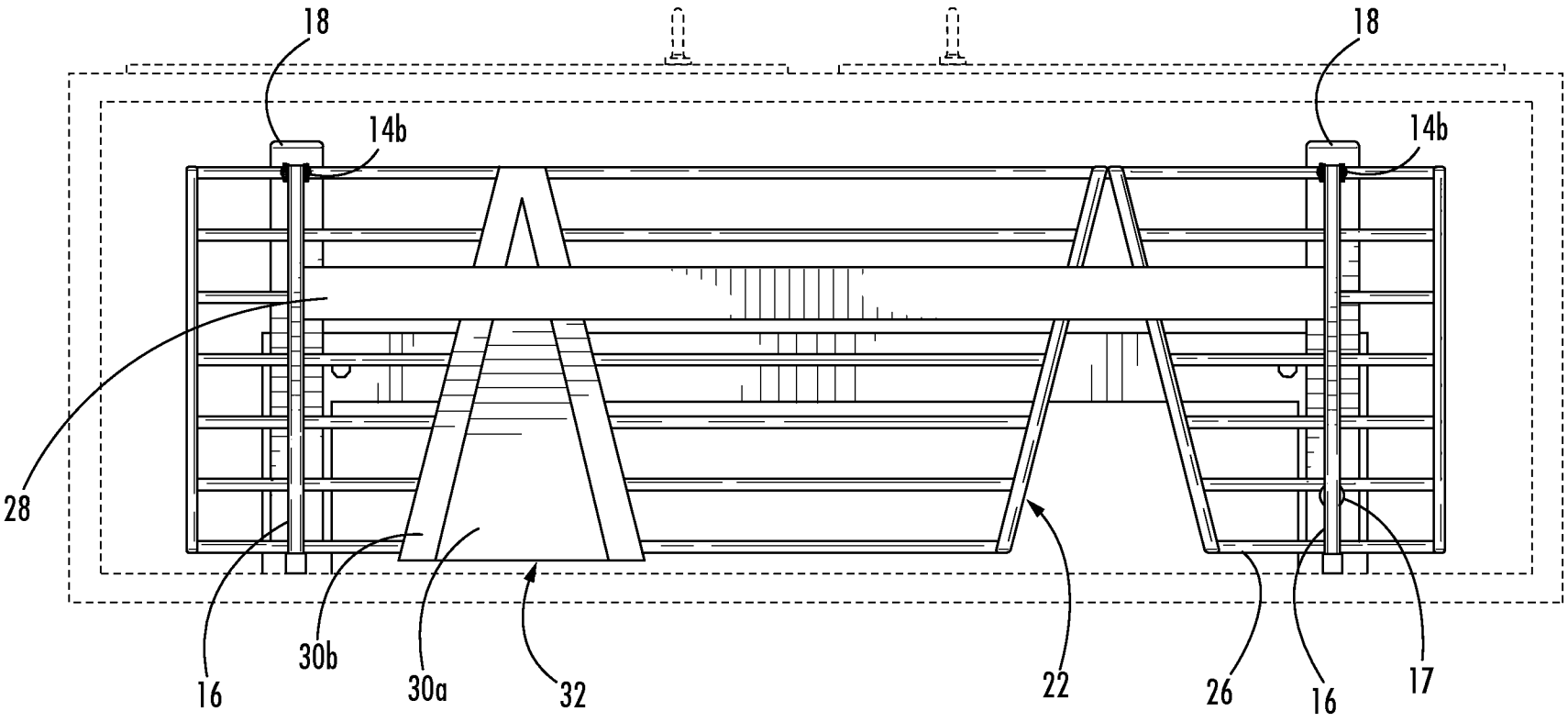
FIG. 7 is a bottom plan view oldie invention in the upper orientation with the top of the vertical support positioned upside-down.

The optional runners 18 depicted in FIGS. 4 and 5, extend outwardly from and generally normal to the rotatable arms 30. Each runner 18 is depicted with an elongated, substantially flat upper and lower surface for aligning the various support members associated with the vertical support 20 into a substantially planar vertical support surface. Generally, the runners 18 are aligned with the second support 23, 24. In one embodiment, the lower support 131 is secured to the upper support 132 which may be secured to the rotatable arm as desired using generally known fastening means such as mechanical fasteners.

Optionally, the upper or lower portion of the rotateable arm 16 may be adapted for magnetic closure of the system 10 in the horizontal position with at least one magnetic receiver or catch 17 associated with the lower cabinet surface 4 and a magnetized region (not shown) associated with the vertical support 20, located near the magnetic catch 17 while the system 10 is in the horizontal, upper-rotated position, the magnetic catch 17 and magnetized region being adapted for magnetic fastening of the vertical support 20 to the cabinet mounting surface 6. While the system 10 is in the closed or horizontal configuration, the optionally magnetic latch 17 receives the magnetized region (not shown) of the vertical support 20.

In the depicted embodiment, each rotateable arm 16 is secured between the vertical support 20 and mounting anchor 20 with each rotateable arm 16 being rigid and having has a generally rectangular-tube shape, although other shapes or configurations may be utilized. In general, the rotateable arm 16 extends between the mounting anchor 12 and the vertical support 20 and is configured fix rotation during transition between the lower and the upper orientations.

Figure 2:
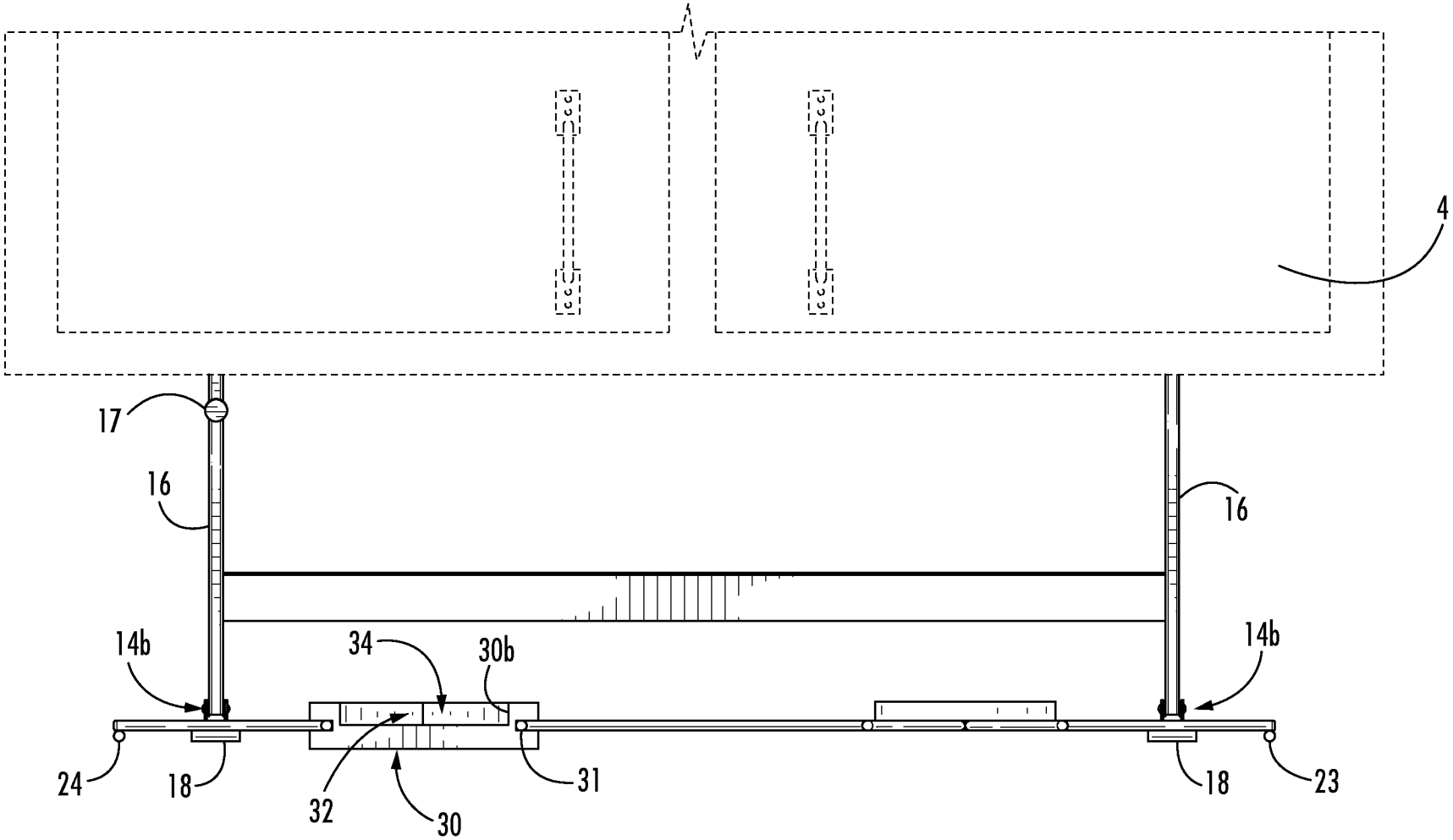
FIG. 2 is a front elevation of the embodiment depicted in FIG. 1.
Figure 3:
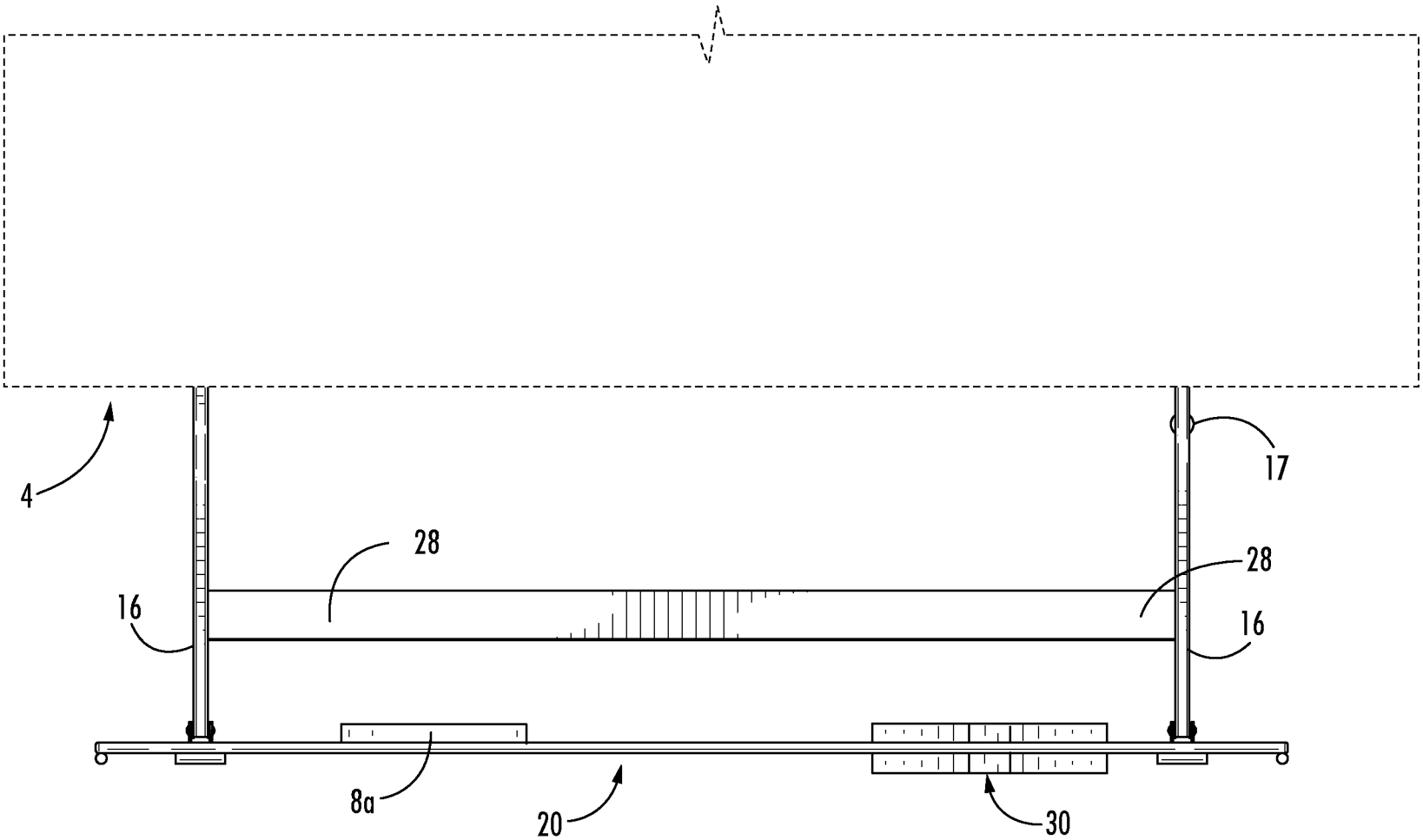
FIG. 3 is a rear elevation of the embodiment depicted in FIG. 1.

A pair of pivoting brackets 14*a*, 14*b* facilitate hinged rotation of the rotateable arm 16 and are positioned at the junctions associated with each of the mounting anchor 12 and the vertical support 20. Generally, the pivoting brackets 14*a*, 14*b* permit hinged rotation of the rotateable arms 16 in one direction but limit any counter-rotation in the opposite rotation. An exemplary upper bracket 14*a* is illustrated in FIG. 1. An exemplary lower bracket 14*b* is depicted in FIG. 2. Each of the illustrated upper and lower brackets 14*a*, 14*b* generally includes a "U-shaped" receiver presenting a pair of outwardly extending arms 14*c* which is fastened around the rotatable arm 16. Each outwardly extending arm 14*c* includes a central aperture, presenting a central passage for passage of a hinge-pin 14*d* therethrough. The shape U-shaped receiver along with the outwardly extending arms 14*c* general limits the rotational freedom of the rotateable arm 16 and as depicted, is generally limited to counter-clockwise rotation of anywhere near ninety-degrees, but could be adapted for rotation with a high-degree of variability somewhere between approximately 30 and 150 degrees of rotation in either direction.

Each rotateable arm 16 can be fixed-length or telescopically-adjustable as desired. In the illustrated embodiment depicted in FIG. 1, each of the rotateable arms 16 has a generally fixed-length. Alternatively, the rotatable arms 16 may be adjustable utilizing telescoping sections which allow for vertical adjustment using an adjustment mechanism. One example of an adjustment mechanism is a spring-biased pushbutton adjustment mechanism (not shown) which provides a plurality of indexing receivers (not shown) adapted for receipt of an outwardly extending button (not shown). The push-button adjustment mechanism (not shown) can be operated by applying an inward force depressing the button (not shown) into the indexing receiver (not shown) and allowing for telescopic adjustment of the plural telescoping sections.

In the embodiment of the system depicted in FIGS. 1-6, a traversing member 28 extends between the pair of rotateable arms 16. The depicted traversing member 28 includes an elongated rectangular strip which has sufficient rigidity to maintain spacing of the rotateable arms 16 and resist lateral movement of the rotateable arms 16 as they rotate during transition of the vertical support 20 between the upper and lower orientations.

The embodiment of the generally planar vertical support 20 depicted in FIG. 1, includes an open grid-like structure with a plurality of cylindrical, rod-like longitudinally extending support members 26 extending longitudinally between a first side member 23 to a second side member 24. In the illustrated configuration of the vertical support 20, the plural cylindrical, rod-like longitudinally extending support members 26 form an upper surface while the first and second side members 24, 24 and the runners 18 form an underlying support surface, for aligning and securing the longitudinally extending support members 26. The vertical support 20 with the open grid-like structure helps minimize visibility and weight while providing sufficient support for any received kitchen, cooking or staging items 8, 8*a*, 8*b* and providing a debris-free surface.

The open grid-like structure associated with the illustrated vertical support 20 terminates at a first and a second angled channel 22. Generally, each angled channel 22 is adapted for slidable receipt of a kitchen, cooking or staging item 8, 8*a*, 8*b*. In the illustrated embodiment depicted in FIG. 1, and by way of example, a pair of angled channels 22 is in slidable receipt of a triangular spoon rest 30 and an exemplary pan lid. The angled channel 22 generally presents an angled receiver which tapers inwardly and includes a pair of oppositely spaced side members 22*a* for slidable receipt of various kitchen, cooking or staging items 8, 8*a*, 8*b*. The angled channels 22 are adapted for receipt of a large variety items 8, 8*a*, 8*b* having various shapes and sizes. Generally, the received items 8, 8*a*, 8*b* are slidable along the angled channel 22 for engagement by the channel side members 22*a* which grip opposite sides of the received item 8, 8*a*, 8*b*, frictionally, magnetically or mechanically. Additionally, the channel side members 22*a* may include a frictional coating or a magnetic surface for improved engagement of the received item 8, 8*a*, 8*b*.

The illustrated spoon rest 30 from FIG. 1 includes a triangular body 30*a* with a pair of upending walls 30*b* extending upwardly from the triangular body 30*a*. The upending walls 30*b* angle inwardly as they extend along opposite sides of the triangular body 30*a* so that the upending walls 30*b* are separated a distance at the base of the triangular body 30*a*, presenting an spoon receiver 32. As the upending walls 30*b* extending along opposite sides of the triangular body 30*a* they angle inwardly, towards each other. In general, the spoon receiver 32 is configured for receiving a spoon or other kitchen utensil (not shown). Each of the upending walls 30*b* presents a channel 31 for slidable receipt by the angled channel 22. Optionally, the spoon rest 30 may include magnets or other means for attachment for removably securing the spoon rest 30 along the angled channel 22 of the vertical support 20.

Generally, the system 10 is configured for storage in the upper orientation. To illustrate operation of the system 10 between an upper and a lower orientation, an exemplary tri-folding technique may be utilized to transition the system 10 between the upper orientation and the lower orientation. Utilizing the exemplary tri-folding technique, two steps may be involved. The first step in the exemplary tri-folding transitioning technique for transition the system 10 from the lower to the upper orientation involves rotating the vertical support 20, clockwise, such that the leading edge of the vertical support 20, the edge closest to the front of the wall cabinet 4, is rotated upwardly towards the pair of rotateable arms 16 for alignment with the rotateable arms 16. Transition from said upper orientation to said lower orientation is similar, in reverse order, except rotation is generally counter-clockwise. For example, first the rotateable arms 16 are rotated counter-clockwise from the horizontal orientation to the vertical orientation and then the vertical support 20 is rotated counter-clockwise from a vertical orientation to a horizontal orientation.

Generally, the trailing edge of the vertical support 20 is pivotally secured to the rotateable arms 16 for pivoted operation as the leading edge of the vertical support 20 is rotated towards the rotateable arms 16. Catch 17 may be used to secure the upper side of the vertical support 20 to at least one of the rotateable arms 16 during aligned receipt of the vertical support 20 by the rotateable arms 16 when the vertical support 20 is rotated from a horizontal orientation to a vertical orientation.

The second step in the exemplary tri-folding transitioning technique the rotateable arms 16 are rotated clockwise up, in aligned receipt of the vertical support 20, from a generally vertical position to a generally horizontal position. In the horizontal position, illustrated in FIG. 7, the rotateable arms 16 extend from the rear of the wall cabinet 4 towards the front of the wall cabinet 6 and the vertical support 20 is positioned between the mounting anchor 12 and the rotateable arms 16 with the leading edge positioned near the wall (not shown) and the trailing edge positioned near the front of the wall cabinet 4. Pivoted rotation of the rotateable arm or arms 16 at the upper bracket 14*a* allows for the rotateable arms 16 to transition from the vertical position to a horizontally position. In the upper orientation, the system 10 may be stored in a recessed manner along or near the cabinet mounting surface 6. In this way, the system 10 may be stored in the recessed horizontal position, while not in use.

It is to be understood that while certain forms of the present invention have been illustrated and described herein, it is not to be limited to the specific forms or arrangement of parts described and shown. The terms, descriptions and figures used herein are set forth by way of illustration only and are not meant as limitations. Those skilled in the art will readily recognize that many variations are possible within the spirit and scope of the present invention in which all terms are given their broadest, reasonable interpretation and that those skilled in the art may make modifications thereto which do not exceed the scope of the appending claims. Therefore, the scope of the invention is only to be limited by the following claims.

What is claimed and desired to be secured by Letters Patent:

1. An under cabinet mounted storage system associated with a mounting surface of a wall cabinet and adapted for repeated movement between an upper orientation and a lower orientation, said under cabinet mounted storage system comprising:

a flattened mounting anchor secured along a pair of outward supports spanned by a spanning member secured to a mounting surface of the wall cabinet;

a substantially planar vertical support structure extending from a first side to a second side and from a leading edge to a trailing edge;

at least one rectangular rotatable arm separating said flattened mounting anchor from said substantially planar vertical support, said rectangular rotatable arm being pivotally secured to at least one of said substantially planar vertical support structure and said mounting anchor whereby said rectangular rotatable arm is rotatable between the upper orientation and the lower orientation;

said rectangular rotatable arm extending substantially vertically in said lower orientation and substantially horizontally in said upper orientation; and said substantially planar vertical support structure being wider than said flattened mounting anchor;

an angled channel extending through said substantially planar vertical support structure wherein said angled channel is configured for slidable receipt of at least a kitchen item, cooking item or staging item when said vertical support structure at the lower orientation.

2. The under cabinet mounted storage system according to claim 1 further comprising a pivoting bracket secured to said rotatable arm, wherein said rectangular rotatable arm is rotatable at said pivoting bracket.

3. The under cabinet mounted storage system according to claim 1 further comprising:

a second rectangular rotatable arm spaced from said first rectangular rotatable arm and extending between said flattened mounting anchor and said substantially planar vertical support; and a traversing member extending between said first rectangular rotatable arm and said second rectangular rotatable arm, whereby said first rectangular rotatable arm and said second rectangular rotatable arm are aligned during rotation between said upper orientation and said lower orientation.

4. The under cabinet mounted storage system according to claim 1 wherein said substantially planar vertical support structure further comprises a plurality of spaced-apart longitudinally extending support members extending from a first side member to a second side member and presenting a spaced apart structure.

5. The under cabinet mounted storage system according to claim 4 wherein said longitudinally extending support members present an upper surface and said first side member and said second side member present an underlying support surface for said longitudinally extending support members.

6. The under cabinet mounted storage system according to claim 1 wherein said angled channel further comprises oppositely spaced side members which angle inwardly, presenting an open triangular receiver configured for slidable receipt of a kitchen, cooking or staging item.

7. The under cabinet mounted storage system according to claim 1 wherein said kitchen, cooking or staging item is a spoon rest.

8. The under cabinet mounted storage system according to claim 1 wherein said substantially planar vertical support structure extends between said upper orientation and said lower orientation as said rectangular rotatable arms are rotated from a horizontal position to a vertical position and wherein said substantially planar vertical support structure is rotated from the vertical position to the horizontal position presenting a horizontal receiving structure with said angled channel for slidably receiving at least one of said kitchen, cooking or staging items.

9. An under cabinet mounted storage system comprising:

a mounting bracket configured for being anchored to a wall cabinet, said mounting bracket including a spanning member extending between a pair of outward supports and having at least one elongated receiver for receiving a fastener therethrough to said wall cabinet, wherein said outward support and said spanning member are substantially planar;

an open vertical support with a leading edge separated from a trailing edge by a plurality of spaced apart cylindrical structures extending laterally between a first longitudinal side and a second longitudinal side, said spaced apart cylindrical structures terminating at an open longitudinal channel;

said open longitudinal channel extending from said leading edge to said trailing edge and configured for slidable receipt of at least a kitchen item, cooking item or staging item;

a pair of pivoting arms separating said mounting bracket from said open vertical support wherein said pivoting arms extend substantially vertically in said lower orientation and extend substantially horizontally in said upper orientation; and a pair of pivoting brackets corresponding to said pivoting arms and configured for rotatably securing said pivoting arms to at least one of said mounting bracket and said open vertical support near said trailing edge, wherein said pivoting brackets and said pivoting arms are generally rectangular.

10. The undercabinet mounted storage system of claim 9 wherein said pivoting brackets slidably receive said pivoting arms.

11. The undercabinet mounted storage system of claim 9 further comprising a longitudinal runner spaced between said first longitudinal side and said second longitudinal side and positioned opposite said mounting bracket, said longitudinal runner secured to at least one of said pivoting brackets and extending from said pivoting arms between said trailing edge and said leading edge.

12. The undercabinet mounted storage system of claim 9 further comprising a longitudinal runner which is in alignment with said open longitudinal channel.

13. The under cabinet mounted storage system of claim 9 wherein one end of said pivoting brackets is secured to at least one of said mounting bracket and said open vertical support.

14. The under cabinet mounted storage system of claim 11 wherein one end of said pivoting brackets is secured to at least one of said mounting bracket and said longitudinal runner.

* * * * *